US009524805B2

(12) United States Patent
Mazaudier et al.

(10) Patent No.: US 9,524,805 B2
(45) Date of Patent: Dec. 20, 2016

(54) DEVICE FOR PROTECTING AGAINST IONISING RADIATION AND CONTAINMENT ENCLOSURE PROVIDED WITH SUCH A DEVICE

(71) Applicant: COMMISSARIAT A L'ENERGIE ATOMIQUE ET AUX ENERGIES ALTERNATIVES, Paris (FR)

(72) Inventors: Fabrice Mazaudier, Manosque (FR); Guy Lamazere, Corbieres (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 14/769,265

(22) PCT Filed: Feb. 19, 2014

(86) PCT No.: PCT/FR2014/000040

§ 371 (c)(1),
(2) Date: Aug. 20, 2015

(87) PCT Pub. No.: WO2014/128368

PCT Pub. Date: Aug. 28, 2014

(65) Prior Publication Data

US 2016/0005502 A1 Jan. 7, 2016

(30) Foreign Application Priority Data

Feb. 21, 2013 (FR) ..... 13 00391

(51) Int. Cl.
*G21F 7/04* (2006.01)
*G21F 7/053* (2006.01)
*G21F 3/035* (2006.01)

(52) U.S. Cl.
CPC ..... *G21F 7/053* (2013.01); *G21F 3/035* (2013.01)

(58) Field of Classification Search
USPC ..... 250/505.1, 506.1, 515.1, 516.1, 517.1, 250/518.1, 519.1
See application file for complete search history.

(56) References Cited

U.S. PATENT DOCUMENTS 3,009,164 A 11/1961 Frey
3,395,957 A * 8/1968 Peele ..... F01P 11/0247 312/1

(Continued)

FOREIGN PATENT DOCUMENTS

| | | |
|---|---|---|
| FR | 2 254 409 | 7/1975 |
| FR | 2 500 355 | 8/1982 |
| FR | 2 685 244 | 6/1993 |

OTHER PUBLICATIONS

International Search Report Issued Apr. 28, 2014 in PCT/FR14/000040 Filed Feb. 19, 2014.

*Primary Examiner* — Nicole Ippolito
(74) *Attorney, Agent, or Firm* — Oblon, McClelland, Maier & Neustadt, L.L.P.

(57) ABSTRACT

A protection device for providing protection against ionizing radiation passing through an orifice defined by a wall bushing structure. The device includes a structure for attenuating ionizing radiation passing through the orifice, which structure can cover, or close off, the orifice, and includes a fastener configured to ensure that the structure for attenuating ionizing radiation can be fastened releasably to the wall bushing structure. The structure for attenuating ionizing radiation includes a sleeve that is open at both ends, that is deformable under its own weight, and that is configured to be fastened to the wall bushing structure by the fastener at a first open end of the sleeve.

15 Claims, 5 Drawing Sheets

(56) References Cited

U.S. PATENT DOCUMENTS

| | | | | |
|---|---|---|---|---|
| 3,907,389 | A | 9/1975 | Cox et al. | |
| 4,251,123 | A * | 2/1981 | Brackenbush | G21F 7/047 160/180 |
| 5,299,243 | A | 3/1994 | Picco | |
| 7,927,558 | B2 * | 4/2011 | Kirollos | G01N 33/0063 2/457 |
| 2006/0048268 | A1 * | 3/2006 | Loos | A41D 19/01529 2/161.6 |
| 2012/0217423 | A1 * | 8/2012 | Larmigny | C08K 3/22 250/516.1 |

* cited by examiner

DEVICE FOR PROTECTING AGAINST IONISING RADIATION AND CONTAINMENT ENCLOSURE PROVIDED WITH SUCH A DEVICE

TECHNICAL FIELD

The present invention relates to a protection device for providing protection against ionizing radiation, and to a confinement enclosure fitted with such a device.

The technical field of the invention is that of fabricating articles for providing protection against ionizing radiation.

STATE OF THE ART

It is known to process or handle objects or materials that emit ionizing radiation—and in particular gamma (γ) rays—inside a confinement enclosure, and in particular inside a glovebox.

For this purpose, at least one wall of the enclosure is pierced by an orifice giving access to the inside of the enclosure and/or enabling material to be passed through the wall.

Such an enclosure is maintained at a pressure that is lower than that of the surroundings or the building in which the enclosure is located in order to avoid dangerous dust that is contained in the enclosure migrating out from the enclosure as a result of the dust (powder or material that can be put into suspension) passing through the orifice.

Such an orifice may be defined by a bushing structure (and may be fitted with such a structure) that is of generally annular shape, passing through the wall of the enclosure and secured to said wall.

Such a wall bushing structure is sometimes referred to as a "glove port" or a "bag port".

In order to protect an operator's hand, forearm, and possibly also upper arm passing through the orifice and into the inside of the enclosure, and in order to confine dust, it is known to secure a glove to the wall bushing structure by engaging the open end of the sleeve of the glove around an annular portion of the structure, which annular portion projects from the outside face of the wall of the enclosure.

Such a glove may include, and/or may be made out of, a material that attenuates ionizing radiation, e.g. an elastomer material containing a metallic filler. The filler may be a metallic powder or a metallic oxide powder. The materials used for this purpose may be lead, tungsten, bismuth, or lanthanum, as described for example in patent FR 2 948 672.

Patent FR 2 254 409 describes a sleeve fastened to a glove port facing a manual access panel to a confinement enclosure that is under pressure—unlike a glovebox containing a radioactive material—and that makes it possible to evacuate the space defined by the sleeve and the panel before an operator's hand penetrates into the confinement enclosure.

Patents FR 2 500 355 and U.S. Pat. No. 3,009,164 describe gloveboxes adapted to handling radioactive materials, in which the gloves are made up of two portions: a sleeve fastened to a glove port and a glove fastened in releasable manner to the sleeve and extending the sleeve.

The radiation attenuating power of those gloves is limited in particular because of the small thickness of the membrane/wall of the glove. Nevertheless, that small thickness enables the glove to conserve sufficient flexibility needed for the manipulations performed by an operator whose hand and arm are engaged in the glove.

As a result, the ionizing radiation given off by the object or the material contained in the enclosure can pass through the glove and the orifice made in the wall of the enclosure.

In order to reduce this radiation, proposals have been made to fit not only the wall bushing structure, but also a cap that covers the orifice while allowing an operator's hand and arm to pass through the cap and the orifice so as to enable the operator to put on the glove or to take it off, without separating the cap from the wall bushing structure.

Such caps including radiation-attenuating deformable wall elements in the form of straps or flaps are described in the following patents: GB 1 455 863; FR 2 590 198; FR 2 642 221; and FR 2 920 334.

When the glove is not in use and the enclosure is maintained at reduced pressure, the glove may become deployed inside the enclosure because of the low pressure therein, and that can interfere with the processing or the manipulation of the object(s) or material(s) inside the enclosure by an operator using another glove secured to another wall bushing structure fitted to the enclosure, and it can also lead to risks of gloves being torn off or damaged by rotary or heater appliances arranged inside the enclosure.

In order to avoid such deployment of an unused glove into the inside of the enclosure, patent FR 2 642 221 proposes pulling the glove to the outside of the enclosure and anchoring the glove by means of the deformable wall elements of the cap. The drawback is that, in that configuration, the wall elements of the cap extend around the glove and the central portion of the cap then no longer performs fully its role of attenuating radiation.

Furthermore, each time an operator removes a hand from the glove, it is recommended to tie a knot in the sleeve of the unused glove, which knot needs to be untied before putting a hand and an arm once more into the glove. The presence of said cap greatly hinders such operations.

Another drawback of caps including deformable wall elements is that the deformable wall elements impede the movements of the hand and the arm of an operator whose hand and arm are engaged in the glove through the cap.

There also exists a need to reinforce the protection against ionizing radiation of the arm and of other portions of the body of an operator engaged in a glove fastened to a wall bushing structure, while not reducing the flexibility of the glove.

SUMMARY OF THE INVENTION

An object of the invention is to propose a protection device for providing protection against ionizing radiation, which device is for fastening to a wall bushing structure and is improved and/or remedies, at least in part, the shortcomings or drawbacks of known devices for providing protection against ionizing radiation.

An object of the invention is to provide a protection device for providing protection against ionizing radiation, for fastening to a wall bushing structure, that satisfies at least one, and preferably more than one of the preceding and following objects:

- reinforcing the protection of the body of an operator whose hand—and possibly also arm—is/are engaged in a glove fastened to the wall bushing structure;
- being easily removable/separable from the wall bushing structure, in particular in order to enable it to be replaced by another protection device;
- limiting or avoiding impeding an operator, and in particular not limiting the amplitude of movement of an operator's arm, hand, and fingers;

not requiring to be separated from the wall bushing structure when an operator seeks to engage a hand and an arm in a glove fastened to the wall bushing structure, or when an operator seeks to remove a hand and an arm from a glove fastened to the wall bushing structure;

making it possible to avoid an unused glove becoming deployed inside an enclosure fitted with the wall bushing structure, while not reducing protection against ionizing radiation; and being suitable for fitting to an existing wall bushing structure (in an existing confinement enclosure).

An object of the invention is to provide a confinement enclosure fitted with such a protection device.

The invention applies in particular to a protection device for providing protection against ionizing radiation passing through an orifice defined by a wall bushing structure, said device including a structure for attenuating ionizing radiation passing through the orifice, which structure is suitable for covering or indeed closing off the orifice, and including fastener means arranged to enable the structure for attenuating ionizing radiation to be releasably fastened to the wall bushing structure.

According to an aspect of the invention, the structure for attenuating ionizing radiation is constituted essentially by a sleeve that is open at both ends, that is deformable under its own weight, and that is arranged to be fastened to the wall bushing structure by said fastener means at a first open end of the sleeve.

The sleeve preferably presents a shape, dimensions, and suitably low stiffness (i.e. suitably high flexibility) to enable it to be turned inside out and extend in part inside the wall bushing structure through the orifice defined thereby and in part beyond the structure, i.e. inside a confinement enclosure having a wall fitted with the bushing structure, thereby reinforcing the protection of an operator's arm engaged in the sleeve and in the orifice.

The sleeve may be secured to said fastener means, the fastener means being provided at a first open end of the sleeve, or being located in the vicinity thereof.

The sleeve is sufficiently large and flexible to cover this first open end when the sleeve is suspended by said fastener means from the wall bushing structure so as to close off the orifice defined by the wall bushing structure when the sleeve is suspended from said structure by said fastener means.

The flexibility of the sleeve, and in particular its capacity for deforming under its own weight, may result from the flexibility and/or the thickness of the material from which the sleeve is made.

In particular, the sleeve may present thickness situated in a range going from approximately 50 micrometers (μm) or 100 μm to approximately 500 μm, 1000 μm, or 2000 μm.

The sleeve may be made of an elastomer material containing a metallic filler, e.g. from a material as described in patent FR 2 948 672, and where appropriate using a method described in that patent.

Said fastener means may be incorporated in the sleeve, in particular in the form of a projection (e.g. a bead) extending along the first open end.

The dimensions of the sleeve are matched to the dimensions of the wall bushing structure and/or to the dimensions of the orifice defined by said structure.

The shape of the sleeve may be straight—i.e. the sleeve may be cylindrical—or it may be flared.

The sleeve may include at least one cylindrical portion that may be extended by at least one flared portion.

In other words, and in another aspect of the invention, the structure for attenuating ionizing radiation is a sleeve that has a first open end arranged to be secured to the wall bushing structure and a second open end that is arranged to pass (is suitable for passing) a glove secured to the wall bushing structure; the sleeve presents capacity for (reversible) deformation that is sufficient to ensure that when the sleeve is suspended by its first end from the wall bushing structure, said first end extending along a plane that is inclined little relative to the vertical, the second opening at its second open end becomes pinched, and a portion of the sleeve extending from the second end becomes flattened, in particular under the effect of the weight of this portion of the sleeve; and the sleeve also presents a shape and dimensions such that in this configuration, when the sleeve is suspended from the wall bushing structure, the sleeve extends over the entire orifice defined by the wall bushing structure so as to cover or close off the orifice and attenuate the ionizing radiation passing through the orifice.

The sleeve may include a first sleeve portion extending in the vicinity of the first open end of the sleeve and presenting a first density; and the sleeve may include a second sleeve portion extending in the vicinity of the second open end of the sleeve and presenting a second density greater than the first density, thereby making it easier to curve and flatten the suspended portion of the sleeve under its own weight.

For this purpose, the sleeve may include ballasting and/or reinforcing means extending in the vicinity of the second open end of the sleeve, e.g. a cuff formed on the sleeve at its second open end.

When the orifice defined by the wall bushing structure is circular, the length of the sleeve portion suspended from said structure is at least equal to the diameter of the orifice, so as to enable the orifice to be covered, and is generally little greater than the diameter; in particular, the ratio of this length to the diameter may lie in a range going from approximately 1 to approximately 1.5, 2, or 4.

In another aspect of the invention, there is provided a confinement enclosure having a wall including a wall bushing structure fitted with a glove and with a protection device as defined or described in the present application.

The stiffness of the sleeve may be of the same order of magnitude as the stiffness of a glove fitted to the enclosure, and in particular not less than that of a glove fitted to the enclosure; in particular, the ratio of the stiffness of the sleeve to the stiffness of the glove may lie in a range going from approximately 0.1 to approximately 10, and in particular in a range going from approximately 0.5 to approximately 2 or 3.

In order to obtain a sleeve of stiffness that is small enough, the sleeve may be made from a material presenting a Young's modulus (modulus of elasticity) lying in a range going from approximately $10^6$ Pascals (Pa) to approximately $10^8$ Pa.

Other aspects, characteristics, or advantages of the invention appear from the following description, which refers to the accompanying drawings and illustrates embodiments of the invention, without any limiting character.

DETAILED DESCRIPTION OF THE INVENTION

Unless indicated explicitly or implicitly to the contrary, elements or members that are structurally or functionally identical or similar are designated by identical references in the various figures.

Figure 1:
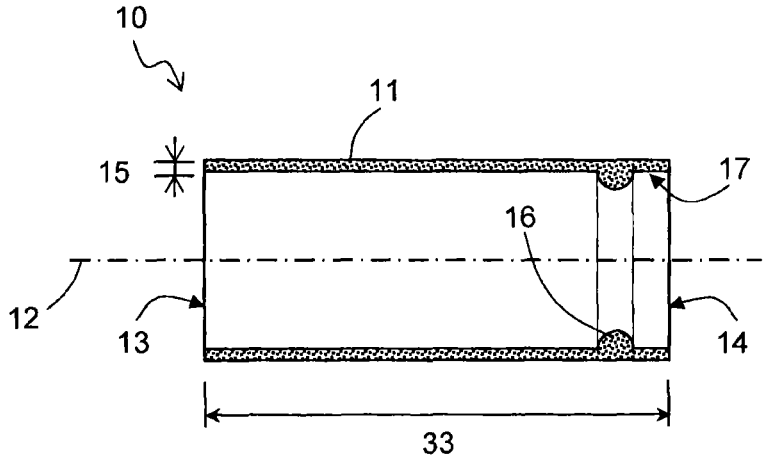
FIG. 1 is a diagrammatic longitudinal section view of a device for providing protection against ionizing radiation in one embodiment.

With reference to FIG. 1 in particular, the protection device 10 is constituted by a sleeve 11 made of an elastomer type polymer material that is filled with metallic particles in order to attenuate the ionizing radiation passing through the wall or membrane forming the sleeve.

The sleeve 11 extends along an axis 12 and is open at both ends 13 and 14.

By way of example, the thickness 15 of the membrane forming this sleeve may be about 100 μm (μm) to 2000 μm.

On its inside face 17 and close to its first open end 14, the sleeve 11 has an annular projection (e.g. a bead) 16 of rounded section extending all around the contour of the opening 14 and at a distance therefrom, being designed to engage in an annular groove formed in a wall bushing structure, as shown in FIGS. 3 to 6, in order to secure the sleeve to the structure.

The protection device 10 shown in FIG. 1 is of cylindrical shape about an axis 12, e.g. being of circular section, in particular in order to be mounted on a wall bushing structure of annular (or tubular) shape and of circular section.

Figure 2:
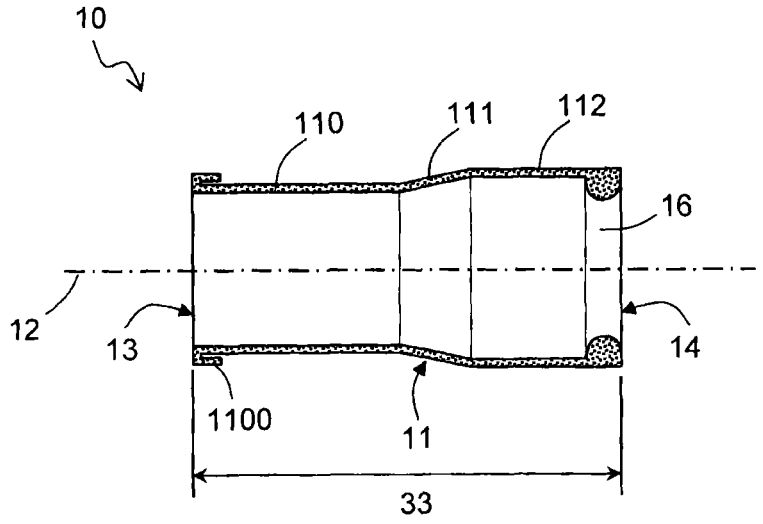
FIG. 2 is a diagrammatic longitudinal section view of a device for providing protection against ionizing radiation in another embodiment.

With reference to FIG. 2, the protection device 10 is constituted by a sleeve comprising a first cylindrical portion 112 extending from the first open end 14, a second cylindrical portion 110 extending from the second open end 13, and a (central) third portion 111 interconnecting the first and second portions 112 and 110, which third portion is of frustoconical shape or of some other flared shape.

The three sleeve portions 110 to 112 may present a common axis 12 of circular symmetry.

In the embodiment shown in FIG. 2, the annular projection 16 extends at the first end of the sleeve and borders the first opening 14.

In addition, in this example, a terminal fraction 1110 of the portion 110 of the sleeve is folded (or turned over) onto the sleeve portion, forming an outside cuff presenting density close to twice the density of the sleeve portion 110, and increased stiffness.

This cuff can serve as ballast encouraging the sleeve 11 to curve relative to the axis 12, and it may serve as reinforcement or stiffening limiting the extent to which the opening 13 is pinched and limiting the flattening of the portion 110 of the sleeve under the effect of the weight of this portion, as described in greater detail with reference to FIGS. 6 and 8, in particular.

With reference to FIGS. 3 to 6 and 9, a confinement enclosure 18 is defined by plane walls 19, 20 that may be made of lead glass, for example, and that are pierced by circular orifices 21, each having a wall bushing structure 22 engaged therein.

With reference to FIGS. 3 to 6, the structure 22 comprises a tubular portion 23 of axis 24 that is orthogonal to the plane of the wall 19, the portion 23 extending through the orifice 21 made in the wall 19 to be present on both sides of the wall.

The structure 22 also has a first annular shoulder 25 of axis 24 extending inside the enclosure 18 at the end of the portion 23 that extends inside the enclosure 18, and from the outside surface of this portion 23 to which the shoulder 25 is secured.

The structure 22 also has an annular abutment 26 of axis 24 that extends outside the enclosure 18 from the outside surface of the portion 23 to which the abutment 26 is secured.

The structure 22 is thus arranged to press against the inside face 190 of the wall 19 by the shoulder 25, and to press against the outside face 191 of the wall 19 via the abutment 26.

The fraction of the tubular portion 23 that extends outside the enclosure 18, projecting from the outside face 191 and the abutment 26, includes a first annular groove 27 receiving an elastic ring 29 provided at the (open) free end of the sleeve 30 of a glove 31 in order to secure the glove 31 in removable manner to the wall bushing structure 22.

The fraction of the tubular portion 23 that extends outside the enclosure 18, projecting from the outside face 191 and the abutment 26, also includes a second annular groove 28 receiving the elastic ring 16 provided at the open first end of the sleeve 11 of the device 10, in order to secure the device 10 in removable manner to the wall bushing structure 22.

The groove 28 for fastening the sleeve 11 is set back from the groove 27 for fastening the glove 31, such that the sleeve 11 can be secured to the structure 22 in any one of the configurations shown in FIGS. 3 to 6.

The fastening of the device 10 to the structure 22 need not be leaktight, and may be obtained by other means for fastening the sleeve, e.g. a clamping collar surrounding the sleeve close its the open first end.

When, as shown in FIGS. 3 to 6, the device 10 is fastened by an annular projection 16 incorporated in the sleeve 11, the annular projection 16 can be engaged around the portion 23 of the structure 22 as far as into the groove 28 by enlarging the opening 14 of the sleeve 11, by (elastically) deforming the sleeve and the projection 16.

Under such circumstances, the perimeter of the outline of the opening 14 of the sleeve 11 is less than the perimeter of the outline of the portion 23 when the sleeve is "at rest", i.e. when the sleeve is not being elastically deformed in order to enlarge the opening 14.

Figure 7:
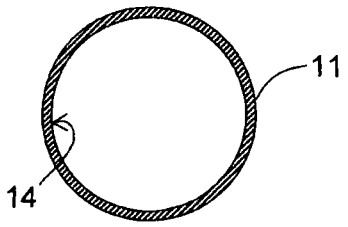
FIGS. 7 and 8 are diagrammatic cross-section views showing two respective end portions of the sleeve in its configuration for closing off the orifice, as shown in FIG. 6.

The outline of the opening 14 of the sleeve 11 then fits closely against the outline of the portion 23 of the structure 22, e.g. a circular outline as shown in FIG. 7.

Figure 3:
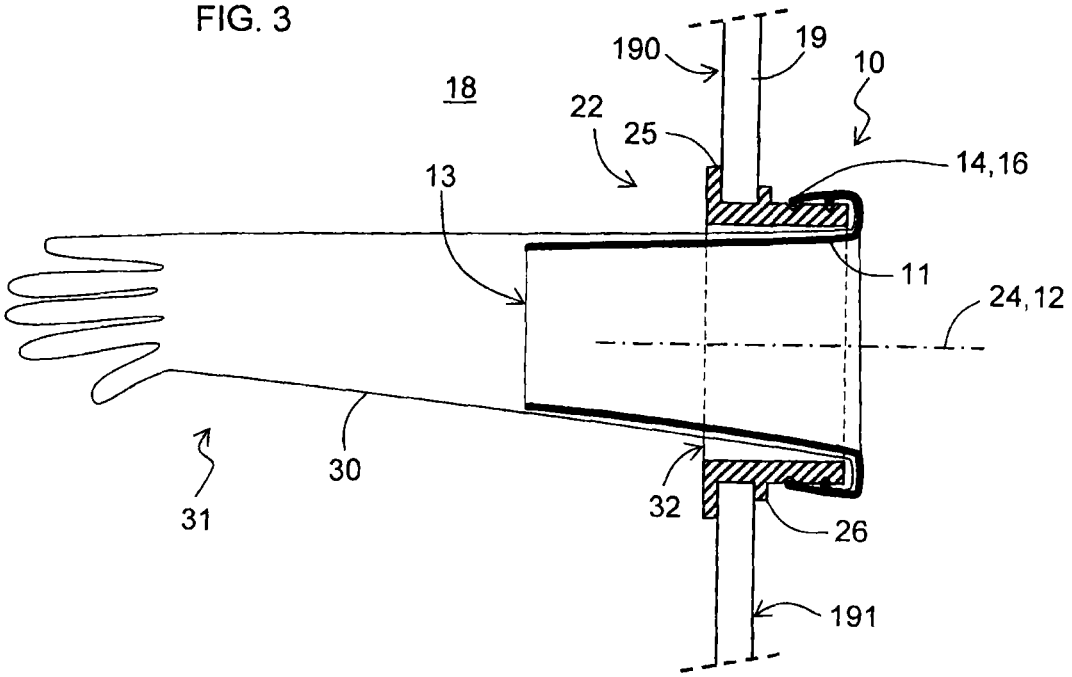
FIGS. 3 to 6 are diagrammatic section views of a wall of a confinement enclosure including a wall bushing structure fitted with a glove and a sleeve for providing protection against ionizing radiation, shown in several distinct configurations: in the configuration shown in FIG. 3, the glove and the sleeve are turned inside out and extend inside the wall bushing structure and the confinement enclosure; this corresponds to a stage in which an operator is using the glove and the sleeve for processing or manipulating an object or material inside the enclosure; in the configuration shown in FIG. 4, the glove and the sleeve are pulled out and extend outside the wall bushing structure and the confinement enclosure; this corresponds to a stage of an operator extracting the glove and the sleeve outside the enclosure; in the configuration shown in FIG. 5, the glove is shortened, and the glove and the sleeve extend outside the wall bushing structure and the confinement enclosure; and in the configuration shown in FIG. 6, the shortened glove extends inside the sleeve and the wall bushing structure, while the sleeve is suspended from the wall bushing structure, corresponding to a stage in which the glove is not in use.
Figure 4:
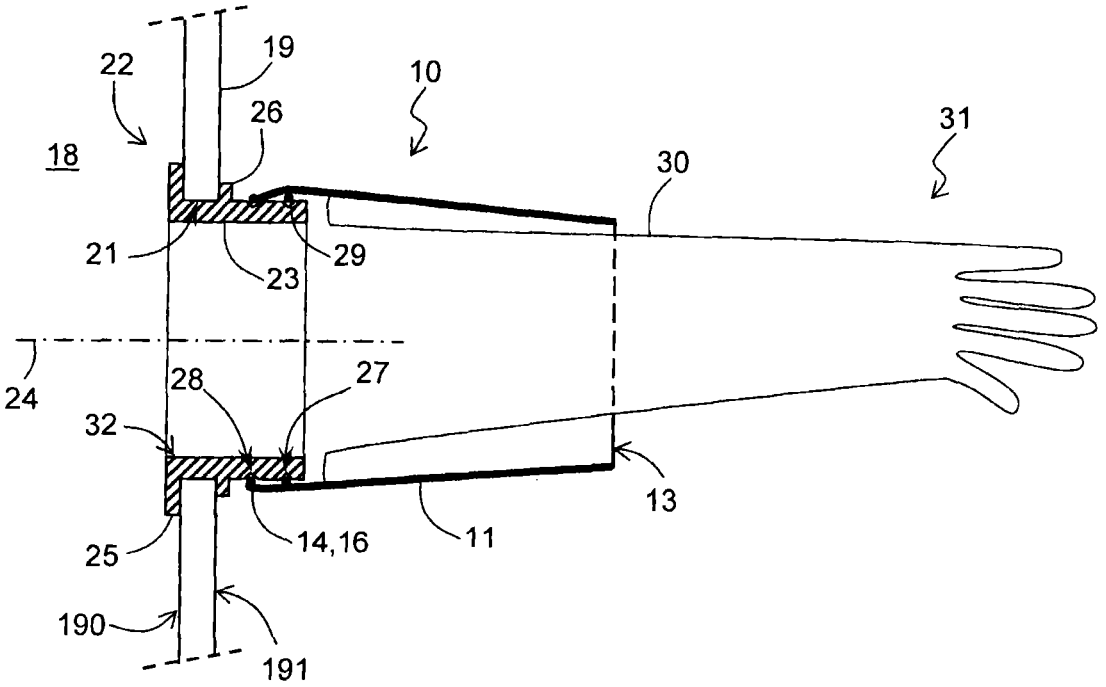
Figure 6:
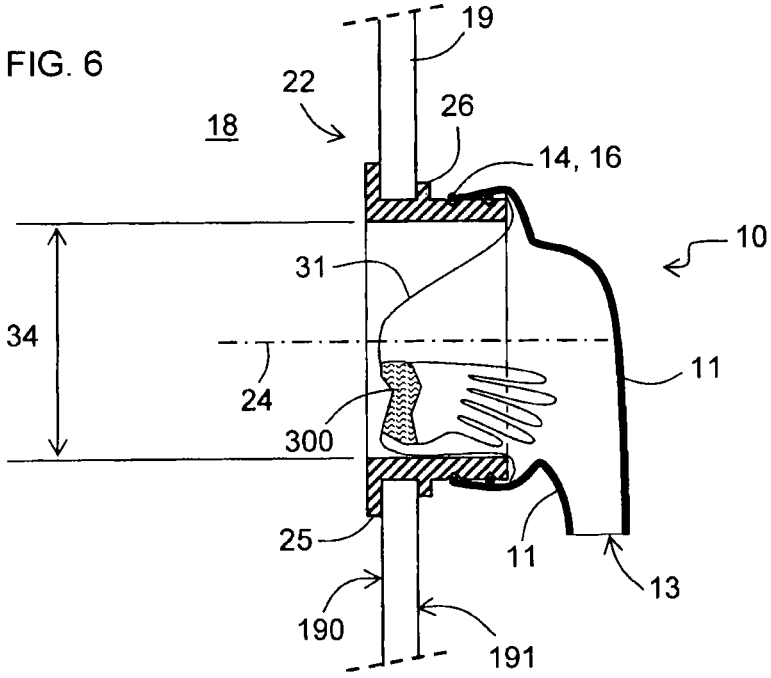

The device 10 and the sleeve 11 are thus arranged so as to deform reversibly and in particular to take up each of the following three configurations:

a first configuration in which the sleeve 11 extends "the right way out" is shown in FIG. 4, with the two open ends of the sleeve 11 extending on the same side of the wall 19, outside the enclosure 18; in this configuration, the open ends 13, 14 of the sleeve 11, and the orifice 21 provided in the wall 19 are substantially parallel and in alignment, making it easy to pass an operator's arm and the glove 31 secured to the structure 22 through the sleeve 11 and through the structure 22;

a second configuration in which the sleeve 11 extends "inside out", as shown in FIG. 3, in which the two open ends 13, 14 of the sleeve 11 are on opposite sides of the orifice 21 and the orifice 32 defined by the wall bushing structure 22; in this configuration, a portion of the sleeve 11 reinforces protection for the arm of an operator engaged in the glove 31 that is secured to the wall bushing structure 22, this portion of the sleeve 11 extending inside the sleeve 30 of the glove 31, and inside the enclosure 18; and a configuration in which the orifice 32 is closed off by the sleeve 11, as shown in FIG. 6, in which the sleeve 11 is suspended from the wall bushing structure by the fastener means 16 provided at its first end 14 so as to cover (close off) the orifice 32.

For this purpose, the length (references 33 in FIGS. 1 and 2) of the sleeve 11 as measured between its ends 13 and 14, or between the fastener means 16 and the second end 13, is adapted to the height 34 (where appropriate the diameter) of the structure 22 and of the orifice 32 defined by the structure in such a manner that the suspended portion of the sleeve 11 extends over the entire orifice.

Figure 8:
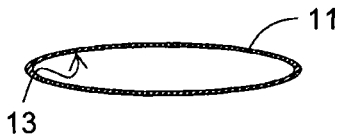
Figure 9:
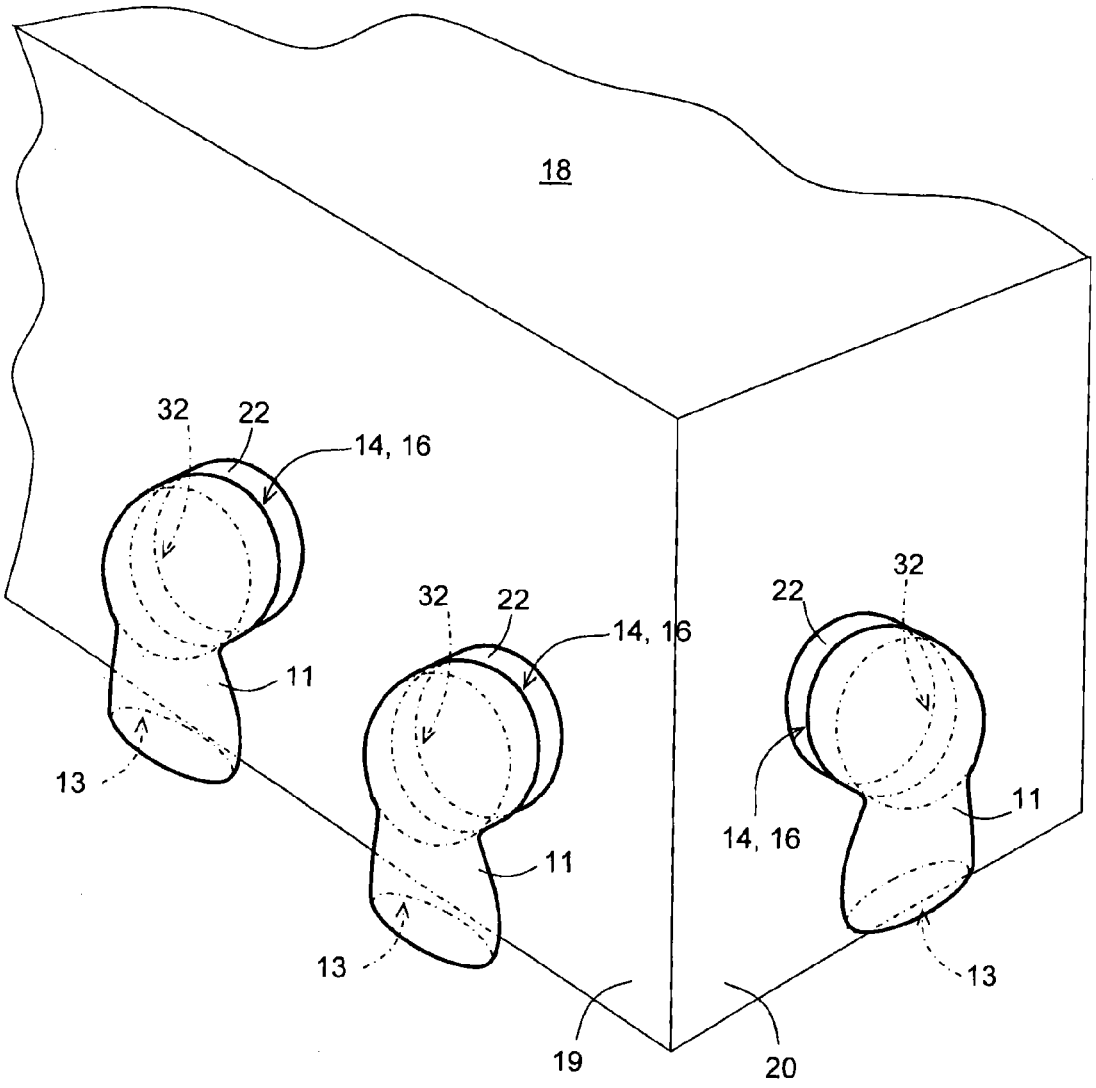
FIG. 9 is a diagrammatic perspective view of a confinement enclosure having a plurality of wall bushing structures, each fitted with a device for providing protection against ionizing radiation.

Furthermore, in this closed-off configuration, the second opening at the second open end 13 becomes pinched, as shown in FIG. 8, and a portion of the sleeve 11 extending from the second end 13 flattens, in particular under the effect of the weight of this portion of the sleeve.

The sleeve 11 and the device 10 make it possible to change between any of these three configurations without requiring significant effort from the operator, and they enable the additional protection provided by the sleeve not to cause any significant impediment for the operator.

Furthermore, the sleeve 11 and the device 10 enable the glove 31 to be shortened and housed in the space defined by the sleeve 11 and the structure 22 while the glove 31 is not in use.

Figure 5:
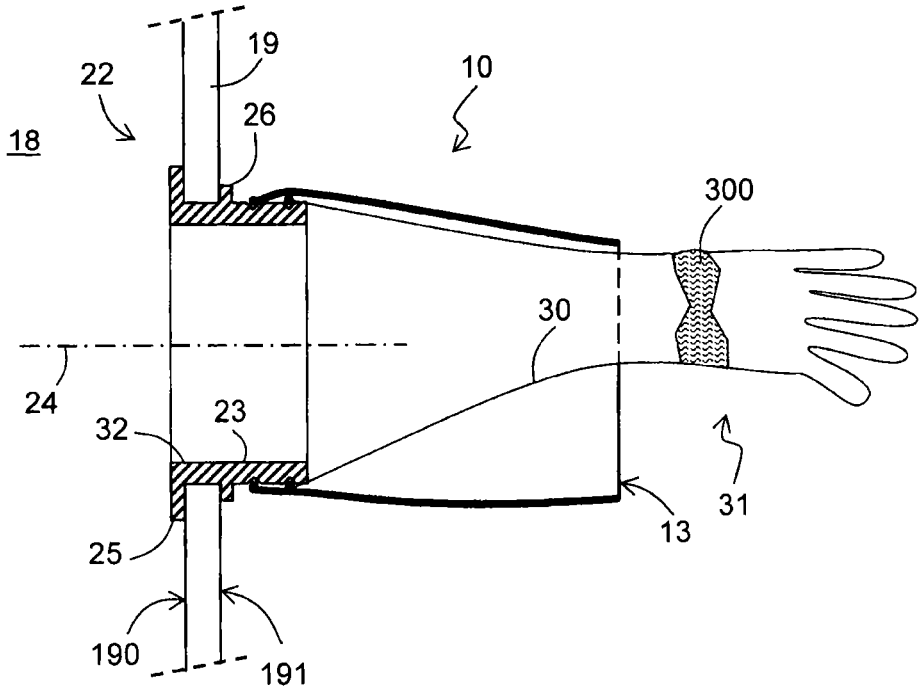

For this purpose, and starting from the configuration shown in FIG. 4, a knot 300 is formed in the stretched sleeve 30 of the glove 31, as shown diagrammatically in FIG. 5, and then the tension on the glove is released so that the glove becomes housed inside the sleeve 11 and the structure 22, as shown in FIG. 6.

From the configuration shown in FIG. 6, in which the glove 31 is not in use, the operator can take hold of the glove 31 by inserting a hand in the pinched, but not closed, opening 13 of the sleeve 11, in order to pull the sleeve of the glove out from the sleeve 11, undo the knot 300 in the sleeve 30 of the glove, and then engage a hand and an arm in the glove 31, turning the glove 31 and the sleeve 11 inside out inside the structure 22, until reaching the working configuration shown in FIG. 3.

The invention claimed is:

1. A protection device for providing protection against ionizing radiation passing through an orifice defined by a wall bushing structure fitted with a glove comprising a sleeve, the protection device comprising:

a structure for attenuating ionizing radiation passing through the orifice, which structure for attenuating ionizing radiation is configured to cover the orifice;

fastener means configured to ensure that the structure for attenuating ionizing radiation can be fastened releasably to the wall bushing structure;

the structure for attenuating ionizing radiation including an attenuation sleeve that is open at both ends, that is deformable under its own weight, that is configured to be fastened to the wall bushing structure by the fastener means at a first open end of the attenuation sleeve, and that is configured to be turned inside out to extend, in part, inside the sleeve of the glove.

2. A device according to claim 1, wherein the attenuation sleeve presents a shape, dimensions, and stiffness to enable it to be turned inside out and to extend in part inside the wall bushing structure through the orifice and in part beyond the wall bushing structure, thereby reinforcing protection of an operator's arm engaged in the attenuation sleeve and in the orifice.

3. A device according to claim 1, wherein the attenuation sleeve presents a thickness in a range from 50 μm or 100 μm up to 500 μm, 1000 μm, or 2000 μm.

4. A device according to claim 1, wherein the attenuation sleeve is made of an elastomer material containing a metallic filler.

5. A device according to claim 1, wherein the fastener means is incorporated, at least in part, in the attenuation sleeve.

6. A device according to claim 1, wherein the fastener means comprises a projection incorporated in the attenuation sleeve and extending along the first open end.

7. A device according to claim 1, wherein the attenuation sleeve includes at least one cylindrical portion and/or at least one flared portion.

8. A device according to claim 1, wherein the attenuation sleeve includes a first sleeve portion extending in a vicinity of the first open end of the sleeve, and presenting a first density, and the sleeve includes a second sleeve portion extending in a vicinity of the second open end of the sleeve, and presenting a second density greater than the first density.

9. A device according to claim 1, wherein the attenuation sleeve includes ballasting and/or reinforcing means extending in a vicinity of the second open end of the attenuation sleeve.

10. A device according to claim 9, wherein the ballasting and/or reinforcing means comprises a cuff formed on the attenuation sleeve at its second open end.

11. A device according to claim 1, wherein the length of a portion of the attenuation sleeve that is suspended from the wall bushing structure is not less than the diameter of the orifice, the ratio of the length to the diameter lying in a range extending from 1 to 1.5 or 2.

12. A confinement enclosure comprising:

a wall pierced by a first orifice; and a wall bushing structure engaged in the first orifice and defining a second orifice, the wall bushing structure being fitted with a glove comprising a sleeve and with a protection device providing protection against ionizing radiation passing through the second orifice, the protection device comprising an attenuation structure for attenuating ionizing radiation passing through the second orifice, which attenuation structure is configured to cover the second orifice, fastener means configured to ensure that the attenuation structure can be fastened releasably to the wall bushing structure, the attenuation structure including an attenuation sleeve that is open at both ends, that is deformable under its own weight, that is configured to be fastened to the wall bushing structure by the fastener means at a first open end of the attenuation sleeve, and that configured to be turned inside out to extend, in part, inside the sleeve of the glove.

13. An enclosure according to claim 12, wherein the attenuation sleeve is made of a material presenting a Young's modulus in a range from approximately $10^6$ Pa to approximately $10^8$ Pa.

14. An enclosure according to claim 12, wherein the attenuation sleeve presents capacity for deformation that is sufficient to ensure that when the attenuation sleeve is suspended by its first end from the wall bushing structure, the second opening at the second open end becomes pinched, and a portion of the attenuation sleeve extending from the second end flattens, under effect of the weight of this portion of the attenuation sleeve; and the attenuation sleeve presents a shape and dimensions such that, in this configuration, when the attenuation sleeve is suspended from the wall bushing structure, the attenuation sleeve extends over the entire second orifice to cover the second orifice and attenuate ionizing radiation passing through the second orifice.

15. An enclosure according to claim 12, wherein the attenuation sleeve is configured to turn inside out to extend in part inside the enclosure.

* * * * *